US006482036B1

(12) United States Patent
Broussard

(10) Patent No.: US 6,482,036 B1
(45) Date of Patent: Nov. 19, 2002

(54) WATERPROOF ELECTRICAL CONNECTOR

(76) Inventor: Blaine L. Broussard, P.O. Box 401, Loreauville, LA (US) 70552

( * ) Notice: Subject to any disclaimer, the term of this patent is extended or adjusted under 35 U.S.C. 154(b) by 0 days.

(21) Appl. No.: 10/172,330

(22) Filed: Jun. 13, 2002

(51) Int. Cl.[7] ..... H01R 13/58
(52) U.S. Cl. ..... 439/606; 439/693
(58) Field of Search ..... 439/606, 736, 439/686, 695, 693, 283, 278, 281

(56) References Cited

U.S. PATENT DOCUMENTS 5,120,268 A 6/1992 Gerrans
5,387,119 A 2/1995 Wood
5,595,497 A 1/1997 Wood
5,641,307 A 6/1997 Gerrans
5,776,564 A 7/1998 Kontants
5,885,108 A * 3/1999 Gerrans, Jr. ..... 439/606
5,984,724 A * 11/1999 NcNeel ..... 439/281
6,165,013 A * 12/2000 Broussard ..... 174/110 SR

OTHER PUBLICATIONS

From the Internet: Duraline Products, "Multi Pin Waterproof Submersible Connectors Systems" USA.
From the Internet: Geo Space, Geophones, "GSC 11 Connector" USA.

* cited by examiner

*Primary Examiner*—Gary Paumen
*Assistant Examiner*—James R. Harvey
(74) *Attorney, Agent, or Firm*—Robert N. Montgomery

(57) ABSTRACT

A waterproof electrical connector utilizing polyurethane bonded to electrical conductive pins, sleeves, polyurethane core, electrical cable conductor insulation, and cable jacket to form a water impenetrable molecular composition around the cable connection in combination with rubber to rubber isolators surrounding the separatable pin and sleeve connection. The connector is useable with or without coupling sleeves.

19 Claims, 4 Drawing Sheets

WATERPROOF ELECTRICAL CONNECTOR

1. FIELD OF THE INVENTION

This invention relates generally to electrical connectors and more particularly to waterproof connectors used in underwater applications such as seismograph and petroleum industry applications.

2. GENERAL BACKGROUND

Electrical connectors used in an underwater environment are subjected to high stress, especially when used in deep water or in seismic exploration where high pressure, explosive forces, and underwater hazards can cause the connectors to leak, thus causing failure of the electrical connection. Connector failure due to leakage can cause the entire system to fail as a result of loss of watertight integrity within the electrical cable. Most underwater cable connectors disclosed in the prior art recognize the need to protect the connectors from high pressure, potential connector separation, and absorption of explosive impact pressure by providing impact absorbing materials molded in place around the cable jackets and the connector pins. Various methods have also been employed in sealing the connector pins themselves as disclosed in U.S. Pat. Nos. 5,120,268, 5,387,119, 5,595,497, and 5,641,307. The U.S. Pat. No. 5,595,497 patent discloses a self-bonding glass-filled polyurethane and polyethylene central core molded around the pins and enclosed within a somewhat softer neoprene rubber body or a blend of neoprene and polyethylene. The softer rubber or blended rubber body is molded around the wires attached to the connector's pins and also extends over a portion of the electrical cable urethane jacket. It is further disclosed that it is preferred that the central core should be bonded during the molding process to the self-bonding softer rubber body and the urethane cable jacket, found on most all underwater electrical cables, without the use of bonding agents, thus, at least in theory, providing a watertight seal between the open face of the connector's pins and the wiring connections. However, in practice, the central core does not form a complete bond with the rubber body or with the urethane cable jacket due to the incompatibility of materials. Urethane cable jackets simply do not bond well with rubber or rubber blended materials. Therefore, leaks can and often do occur under high pressure. Further, no steps are taken to insure a bond between the individual wiring dielectric insulation or sheath and the molded neoprene rubber body. In many cases, the molding material and the wiring insulation material are dissimilar, and therefore do not bond. Wiring conductor insulation is often a thermoplastic material, such as polypropylene, which provides excellent dielectric qualities at an economical cost and purposely prevents the electrical conductors from adhering together under heat and pressure during manufacture and storage. However, the thermoplastic polyurethane, used as a molding material in the connectors discussed above, does not allow the two materials to form a positive bond without the introduction of a chemical bonding agent. It has also been observed that extreme care must be taken to insure that the molded body material must always form a complete fill around the wiring connection to the connector's pins and bond equally to them as well.

Others have observed this problem and have attempted to solve the problem for a particular need, such as that disclosed by U.S. Pat. No. 5,776,564 which addresses the problem of bonding a polyamide-based mixture for its connector body to a polytetrafluoroethylene wiring insulation by coating the insulation sheath with a thermoplastic elastomer on a polyester base. This process, while allowing a chemical bond between the two components, is only useful with specific wire coatings and then only with a specific body matrix. There is no proof that the process mentioned by the U.S. Pat. No. 5,776,564 disclosure will provide a chemical bond with any and all combinations of thermoplastic material nor does it purport to provide a waterproof seal. Therefore, several claims were made to include various combinations, none of which include the use of polyurethane or the process of multiple removable sheaths as disclosed herein.

Connectors that are principally used underwater and subjected to high pressure and continuous heavy abuse must insure watertight integrity. Further, the process of insuring compatibility must be uniform without the need for chemical analysis of each component during the molding process.

It therefore follows that, if a tear or rip in the cable jacket occurs adjacent the cable connector, water is allowed to enter the cable under pressure and migrate along the conductors sheaths. If no permanent seal exists between the wiring insulation and the molded connector, water is allowed to ultimately reach the connector pin connection, in which case a short circuit occurs between the affected pins. Further, water may also be forced into whatever the cable and its connector is attached to opposite the connector, such as a main cable splice, thus affecting other connectors fixed thereto, which may result in catastrophic failure of the entire system.

If an incomplete fill occurs during molding of the connector, a void may develop which may fill with water due to leakage, thus causing a direct short circuit between the pins or at least a reading to ground.

3. SUMMARY OF THE INVENTION

A molded, waterproof, multi-pin connector constructed with a more positive sealing capability due to better material bonding during the molding process, the connector being compatible with other selected manufacturers' connectors. The electrical connector assembly includes mating connector bodies with like material components bonded together for a more positive seal separated by rubber-to-rubber isolator bodies.

4. BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

5. DETAILED DESCRIPTION OF THE PREFERRED EMBODIMENT

Figure 1:
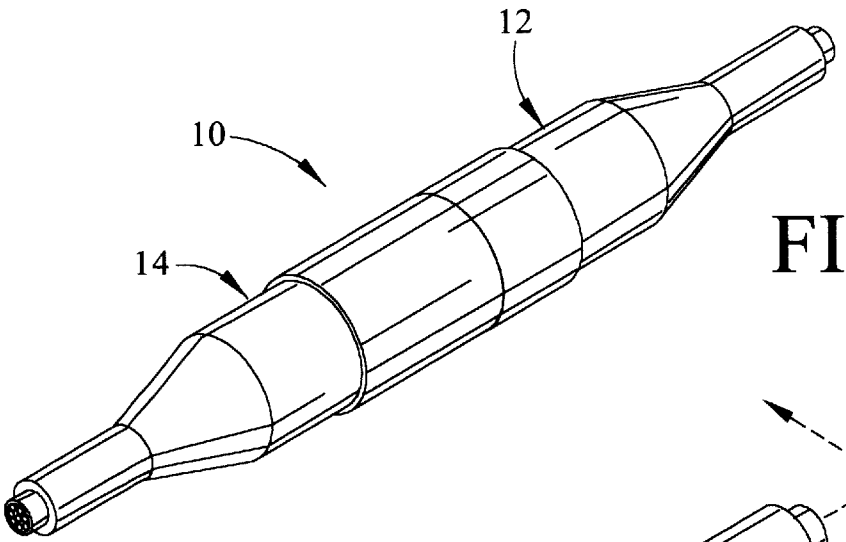
FIG. 1 is an isometric view of the preferred embodiment of mated connector bodies.
Figure 2:
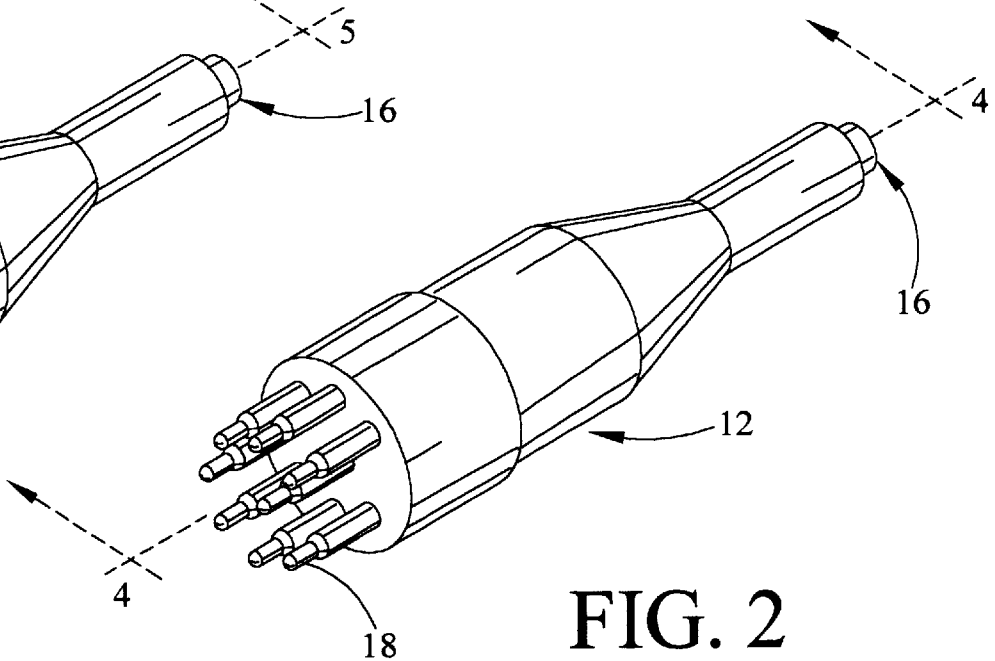
FIG. 2 is an isometric view of the pin connector body assembly.
Figure 3:
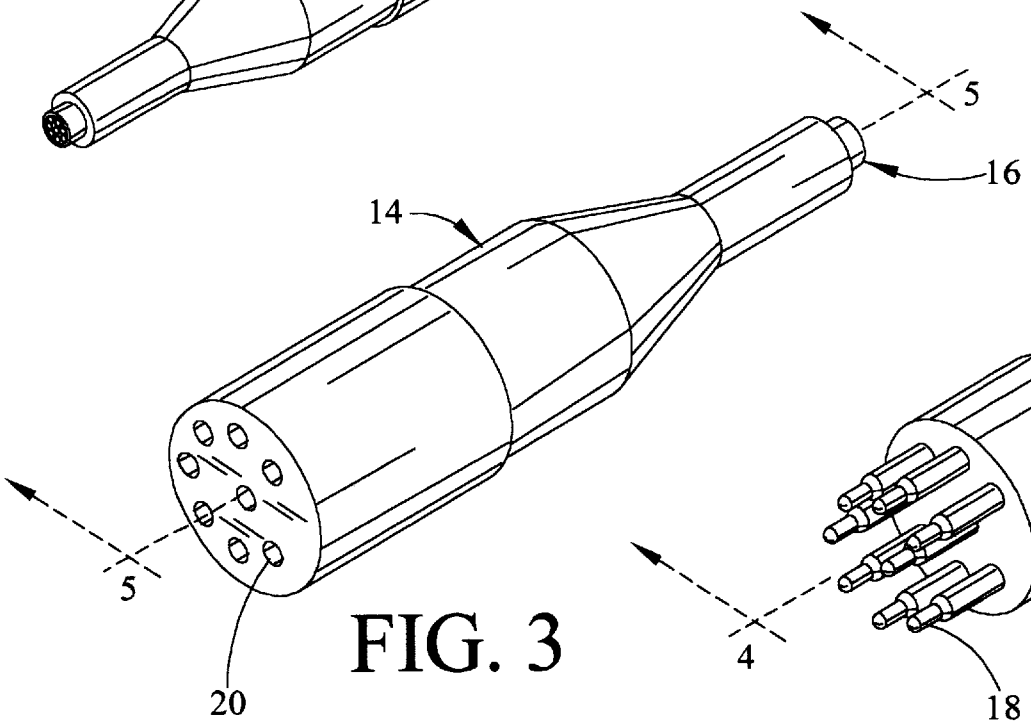
FIG. 3 is an isometric view of the socket connector body assembly.

Basically, connector bodies are configured for connecting a pin connector body 12 to a mating socket connector body 14 as in the assembly 10 illustrated in the FIG. 1. As further seen in FIG. 2 and FIG. 3 connector bodies 12, 14 are often molded in place around the electrical wire cable sheath 16 in an attempt to insure a watertight enclosure for the cable's electrical wire connection to the pins and sockets. It is also necessary to provide a watertight connection for the pins 18 seen in FIG. 2 and the sockets 20 recessed within the socket body seen in FIG. 3. Such connector connections are common within the art. However, the teaching of the prior art fails to effectively address the problems of bonding the molded connector body material 23 in an effective manner to the outer sheathing 22 of the electrical cable 16 and to the wire insulation sheathing 24, as seen in FIG. 4, in a manner that effectively blocks water migration through and around the electrical cable 16.

Most all underwater cables 16 are constructed with heavy-duty polyurethane outer jackets 22. However, the individual conductor wire insulation is a thermoplastic material, such as polypropylene, which provides excellent dielectric qualities at an economical cost and purposely prevents the electrical conductors from adhering together under heat and pressure during manufacture and storage. However, the thermoplastic polyurethane material 23, commonly used as a molding material in the connector bodies discussed above, does not allow the two materials to form a positive bond without the introduction of a chemical bonding agent. Therefore, as previously taught in our earlier patents, it is essential to insure a positive cable seal that special cabling be utilized having wire sheaths 24 with at least one layer of polyurethane that can be exposed to the molded polyurethane 23 as it is molded around each of the wire sheaths 24 and the polyurethane cable sheath 22, thereby forming a positive molecular bond between like materials. Likewise the electrical conductive pins 18 seen in FIG. 4 and the electrical conductive socket connector pins or sleeves 28 seen in FIG. 5 being contained in a molded core of glass filled polyurethane 30 also readily bond to the urethane body material 23. The connector bodies 12 and 14 can therefore be effectively bonded to the cable and pins without the use of chemical bonding agents as a result of simply utilizing like materials.

Figure 4:
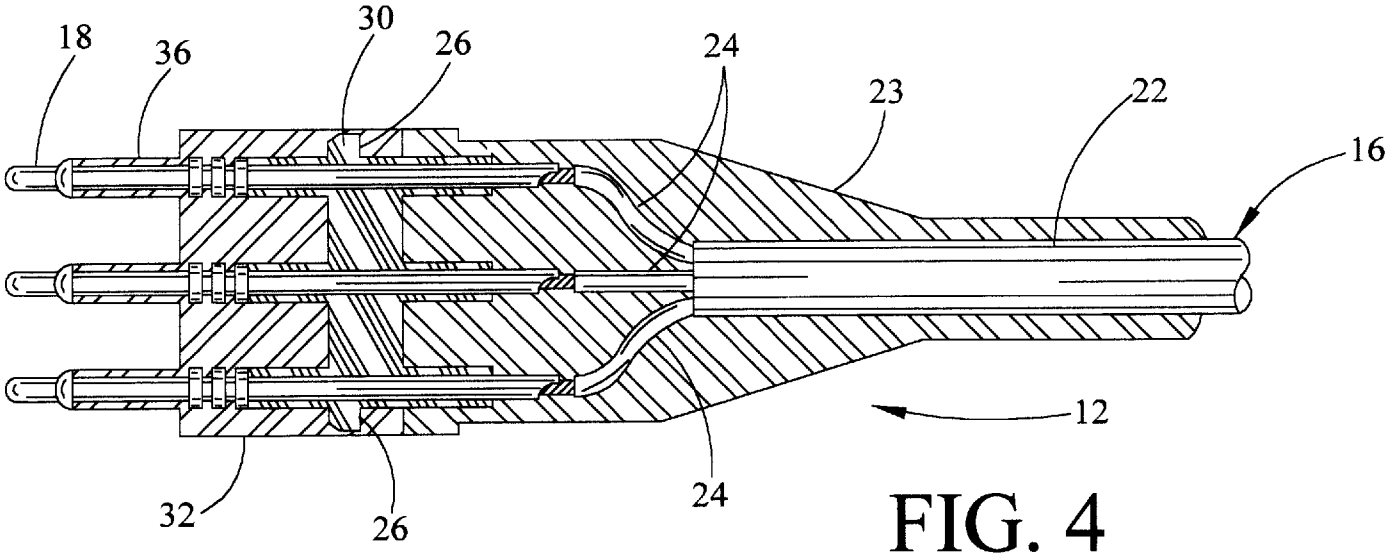
FIG. 4 is a cross section view taken along sight line 4—4 seen in FIG. 2.
Figure 5:
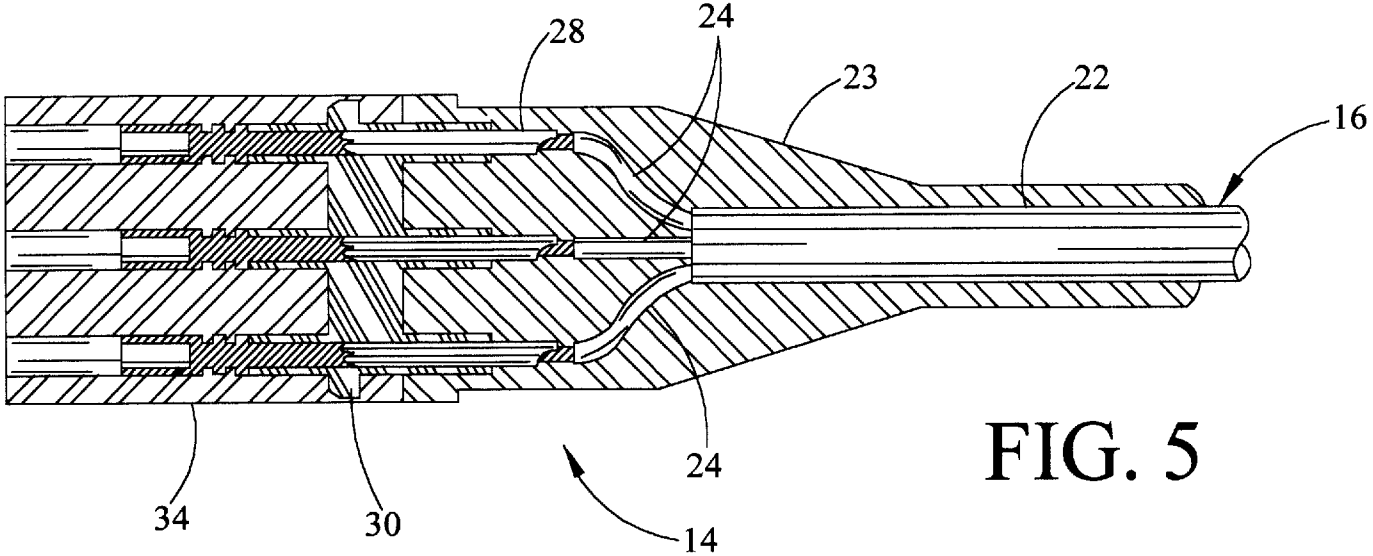
FIG. 5 is a cross section view taken along sight line 5—5 seen in FIG. 3.

Since hard rubber is commonly used and found to be especially effective for sealing the pin to socket connection, it is utilized as an isolator body 32 in body member 12, seen in FIG. 4, and body member 14, seen in FIG. 5. As seen in FIG. 4, the rubber isolator 32 is captured by the glass-filled polyurethane core 30 along the lip 26 at one end and extends upwardly into sleeves encompassing a portion of the pins 18. The isolators 32, 34 may be installed as a mechanical fitted component molded separately or molded in place. To insure a perfect seal when used as a mechanically fitted component, the isolator member 32, 34 may also be chemically bonded with a sealer where it makes contact with the poly-core member 30, the polyurethane body material 23, and the pins 18, 28.

Figure 6:
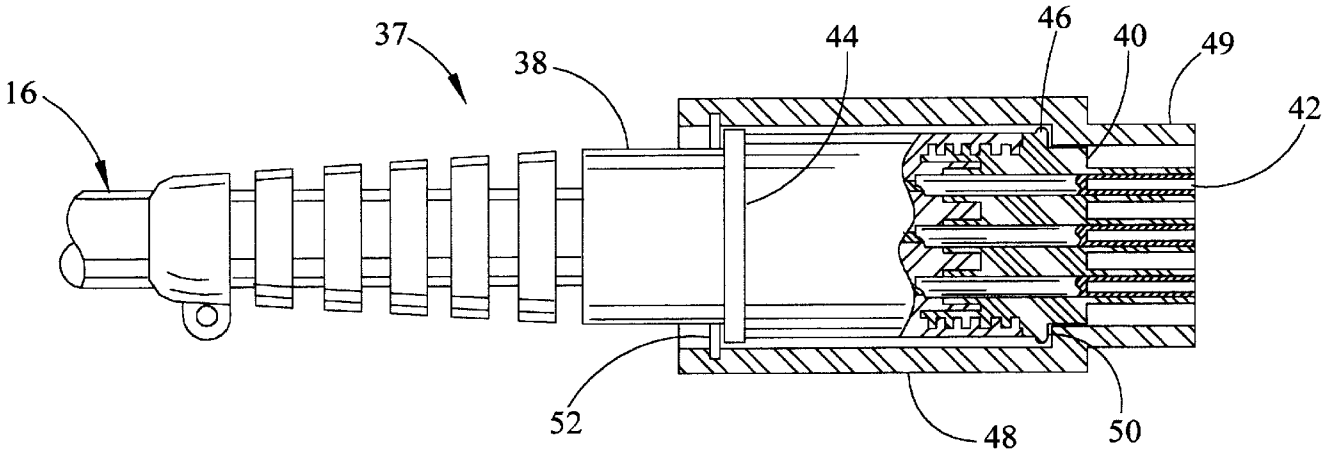
FIG. 6 Prior Art
FIG. 6 is a partial cut-away view of a prior art socket connector assembly.
Figure 8:
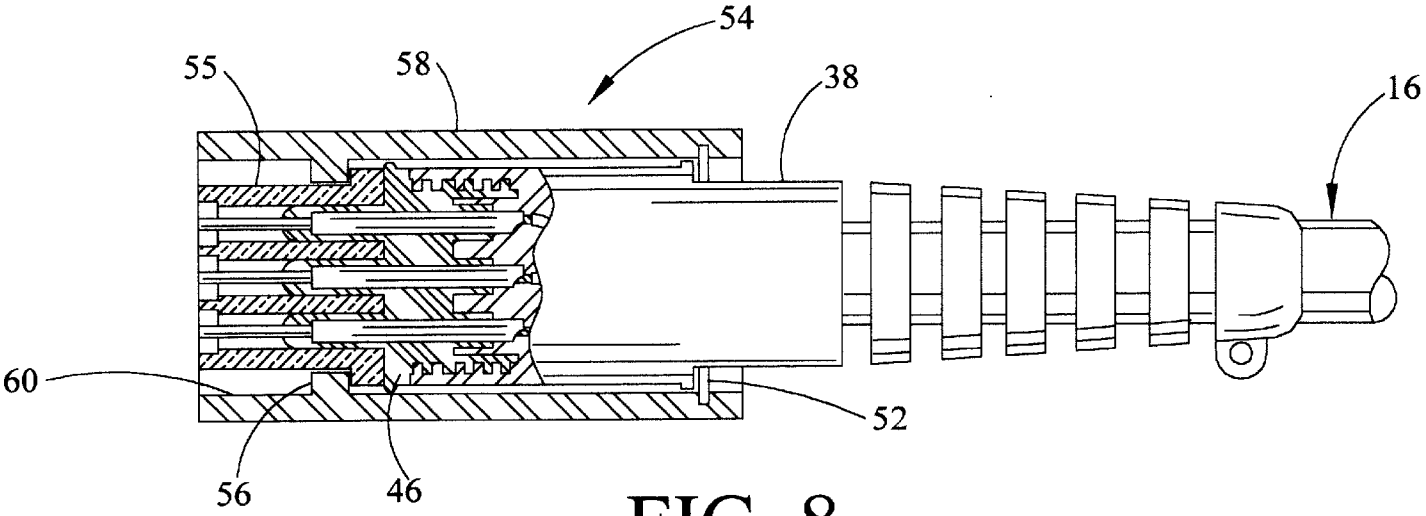
FIG. 8 Prior Art
FIG. 8 is a partial cut-away view of a prior art pin connector assembly.

In some cases it is advantageous to have some means of mechanically securing the pin connector body to the socket connector body, in which case a threaded rotatable sleeve member is provided on each of the body members as illustrated by the prior art connectors shown in FIGS. 6 and 8. As seen in FIG. 6, the prior art socket pin connector body assembly 37 utilizes a flexible poly material 38 molded around the electrical cable 16, between the electrical wires, and bonded to a rigid core pin separator 40. It should be noted that the pin core material extends upwardly and surrounds the pin sockets 42. A shoulder 44 is provided rearwardly along the flexible body member and shoulder 46 is also provided around the perimeter of the pin core member 40. The rotatable sleeve 48, having an external threaded portion 49 and an internal shoulder 50 corresponding to the shoulder 46, is secured to the connector body 38 by a lock ring 52, thereby capturing the poly pin core and preventing separation of the core 40 from the body 38 when separating the connector bodies.

The matting pin connector body assembly 54 seen in FIG. 8 utilizes many of the same components as the connector body assembly 37 seen in FIG. 6, except in this case a socket member 55 having multi-pin sockets is bonded to the pin core member 45 by some means and captured in similar manner by a shoulder 56 located within the rotatable sleeve 58 also containing mating internal threads 60. It should be noted that the socket member 55 is bonded to the pin core 46 along a single surface, which could be subjected to flexure and failure under pressure.

Since no universal underwater connector exists and many service companies often use connectors supplied by several manufacturers, it becomes necessary for one manufacture's connector to mate with other compatible connectors whenever possible.

Figure 7:
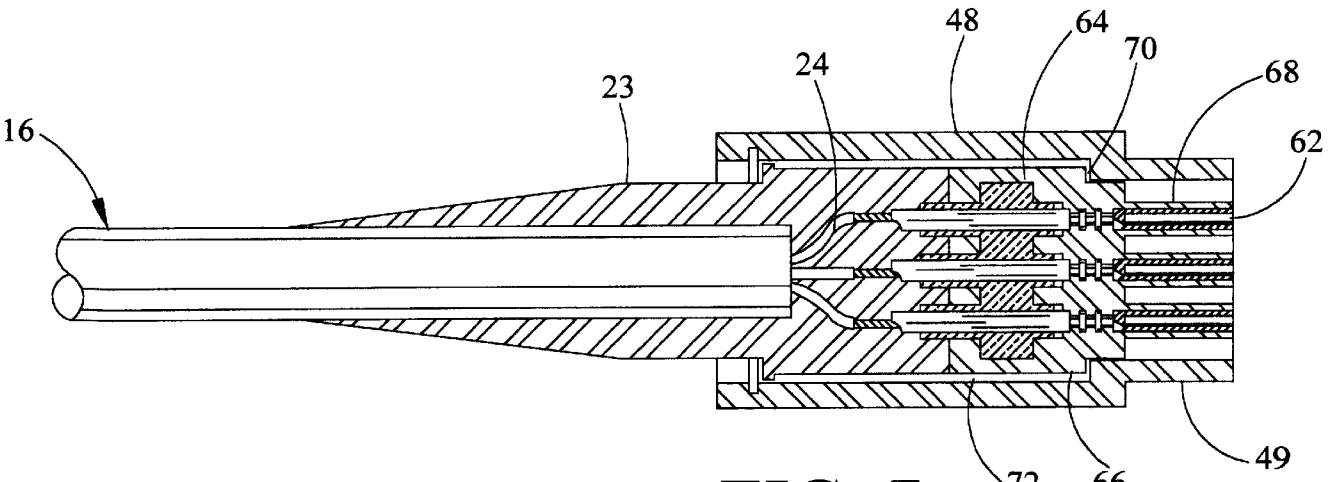
FIG. 7 is a cross section view of the socket assembly illustrated in FIG. 3 adapted for connectability with the prior art connector illustrated in FIG. 8 or with the adapted pin connector body assembly illustrated in FIG. 9.
Figure 9:
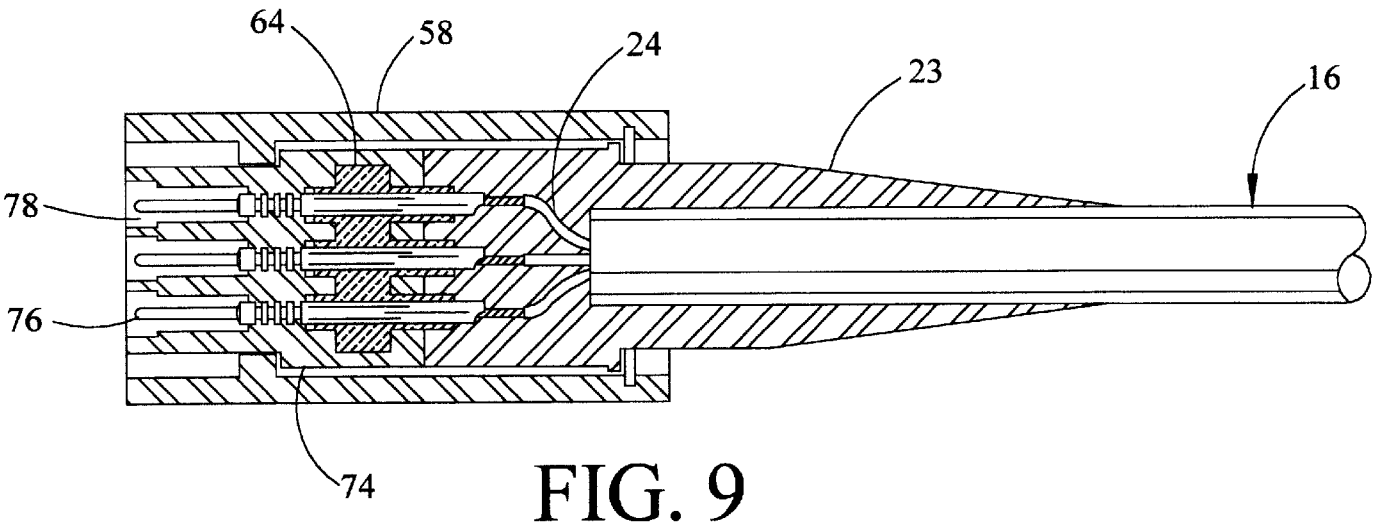
FIG. 9 is a cross section view of a pin connector assembly configured for connectability with the prior art socket connector assembly shown in FIG. 6 or with the adapted pin connector body assembly illustrated in FIG. 7.

Therefore, it becomes advantageous to configure the connector assemblies shown in FIGS. 7 and 9 using the same principles utilized in FIG. 4 and 5 to mate with the connectors shown in FIGS. 6 and 8.

To make the connector shown in FIG. 5 compatible with the connector shown in FIG. 8 the connector body is formed or molded in a three step process as shown in FIG. 7. The socket pins 62 are first arranged and molded in a glass filled polyurethane core 64 as is common in the art. Next the socket pins 62 and their poly-core 64 are encased in hard rubber isolator 66 including a jacketing portion 68 around the socket portion of the pins 62 the hard rubber isolator 66 having a shoulder 70 corresponding to the internal shoulder 50 of the relatable sleeve 48 shown in FIG. 6. The electrical cable 16 is then integrally molded into the connector body polyurethane material 23, thereby providing a molecular bond with the polyurethane cable jacket 22, its conductor wires having special polyurethane insulation sheathes 24, and with the hard rubber isolator 66 forming a seamless bonded joint at juncture 72 with the rubber isolator 66.

The pin connector shown in FIG. 9 is made compatible with the prior art connector shown in FIG. 6 in a similar manner as that disclosed above for the socket connector shown in FIG. 7, except that the hard rubber isolator 74 encapsulating the glass filled polyurethane core 64 now containing pins 76 now extends upwards forming sockets 78 surrounding each pin 76 corresponding to the outer diameter of the glass filled polyurethane encased socket pins 42 shown in the prior art connector 37 seen in FIG. 6.

The embodiments shown herein are typical examples of the technology disclosed and may vary depending on the need for cooperative coupling with competitive connectors.

However, the essential principle taught herein is the need to maintain watertight integrity by insuring material bonding by isolating like materials during the molding process and the introduction of compatible materials wherever necessary to insure self bonding.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A waterproof electrical connector comprising:

a) a first connector body member comprising:

i) a molded, glass-filled, polyurethane core;

ii) a plurality of electrically conductive pins radially arranged around a central longitudinal axis of said core;

iii) a length of electrical cable having a plurality of electrical wire conductors sheathed in a polyurethane jacket, said conductors connected to said electrically conductive pins;

iv) a first polyurethane body molded in place encasing said electrical wire conductors, a portion of said polyurethane core, a portion of said pins, and a portion of said polyurethane jacket molecularly bonding thereto;

v) a molded rubber isolator body forming a sleeve around said electrical pins and encapsulating at least a portion of said core opposite said polyurethane body;

b) a second connector body member comprising:

i) a second molded, glass-filled, polyurethane core;

ii) a plurality of electrically conductive sleeves mateable with said conductive pins located within said first connector body radially arranged around a central longitudinal axis of said core;

iii) a second length of electrical cable having a plurality of electrical wire conductors sheathed in a polyurethane jacket, said conductors connected to said electrically conductive sleeves;

iv) a first polyurethane body encasing said electrical wire conductors, a portion of said polyurethane core, a portion of said pins, and a portion of said polyurethane jacket, molecularly bonding thereto; and v) a second molded rubber isolator body having a plurality of sockets cooperative with said pins located within said first connector body leading to each of said electrical sleeves and encapsulating at least a portion of said core opposite said second polyurethane body.

2. The connector according to claim 1 wherein each of said wire conductors is sheathed in at least one polyurethane insulation jacket.

3. The connector according to claim 2 wherein said at least one polyurethane insulation jacket is exposed to said polyurethane body during molding.

4. The connector according to claim 1 wherein said connector further comprises a rigid relatable sleeve secured to each of said first and second body member each said relatable sleeve being threadably connectable to the other.

5. A waterproof electrical connector comprising:

a) a first connector body member having a plurality of electrically conductive pins radially arranged around a central longitudinal axis of a first molded glass-filled polyurethane core;

b) a first electrical cable having a plurality of electrical wire conductors sheathed in a polyurethane jacket, each of said electrical wire conductors having at least one polyurethane insulation sheath, said conductors connected to said electrically conductive pins in a manner whereby said polyurethane insulation sheath is exposed;

c) a first polyurethane body encasing said electrical wire conductors, a portion of said polyurethane core, said pins, and a portion of said polyurethane jacket, self bonded thereto;

d) a first molded rubber isolator forming a sleeve around said electrical pins and encapsulating at least a portion of said core opposite said first polyurethane body;

e) a second connector body member having a plurality of electrically conductive sleeves radially arranged around a central longitudinal axis of a second molded glass filled polyurethane core, said sleeves arranged and adapted to receive said conductive pins located in said first connector body;

f) a second electrical cable having a plurality of electrical wire conductors sheathed in a polyurethane jacket, each of said electrical wire conductors having at least one polyurethane insulation sheath, said conductors connected to said electrically conductive sleeves in a manner whereby said polyurethane insulation sheath is exposed;

g) a second polyurethane body forming a portion of said second connector body encasing said second electrical wire conductors, a portion of said polyurethane core, said sleeves, and a portion of said polyurethane jacket, self bonded thereto; and h) a second molded hard rubber isolator having a plurality of sockets cooperative with said pins in said first connector body leading to each of said electrical sleeves and encapsulating at least a portion of said core opposite said second polyurethane body.

6. The connector according to claim 5 wherein each said polyurethane body comprises a shoulder portion.

7. The connector according to claim 6 wherein each said isolator comprises a shoulder portion.

8. The connector according to claim 5 wherein said polyurethane body in said first connector body is bonded to said first isolator.

9. The connector according to claim 5 wherein said polyurethane body in said second connector body is bonded to said second isolator.

10. The connector according to claim 7 wherein each said first and second connector body is housed within a relatable rigid housing having an internal shoulder portion cooperative with said shoulder portion of each said first and second isolator.

11. The connector according to claim 10 wherein each said relatable rigid housing is secured to each said first and second polyurethane body by a lock ring located behind said shoulder portion of each said polyurethane body.

12. The connector according to claim 11 wherein said rigid housing secured to said first polyurethane body is threadably coupleable to said rigid housing secured to said second polyurethane body.

13. The connector according to claim 5 wherein said plurality of sockets cooperative with said pins in said first connector body leading to each of said electrical sleeves within said second isolator are eliminated and said isolator is adapted to form a thin jacket around a portion of each of said electrical sleeves.

14. The connector according to claim 13 wherein said first molded rubber isolator forming a sleeve around said electrical pins is adapted to comprise a plurality of sockets cooperative with said conductive sleeves, including said thin jacket located within said second connector body.

15. A method of insuring a positive watertight seal under pressure and stress comprising the steps of:

a) Providing a cable connector comprising:

a) a first connector body member comprising:

i) a molded, glass-filled, polyurethane core;

ii) a plurality of electrically conductive pins radially arranged around a central longitudinal axis of said core;

iii) a length of electrical cable having a plurality of electrical wire conductors sheathed in a polyurethane jacket, said conductors connected to said electrically conductive pins;

iv) a first polyurethane body encasing said electrical wire conductors, a portion of said polyurethane core, a portion of said pins, and a portion of said polyurethane jacket, molecularly bonding thereto;

v) a molded rubber isolator body forming a sleeve around said electrical pins and encapsulating at least a portion of said core opposite said polyurethane body;

b) a second connector body member comprising:

i) a second molded, glass-filled, polyurethane core;

ii) a plurality of electrically conductive sleeves mateable with said conductive pins located within said first connector body radially arranged around a central longitudinal axis of said core;

iii) a second length of electrical cable having a plurality of electrical wire conductors sheathed in a polyurethane jacket, said conductors connected to said electrically conductive sleeves;

iv) a second polyurethane body encasing said electrical wire conductors, a portion of said polyurethane core, a portion of said pins, and a portion of said polyurethane jacket, molecular bonding thereto; and v) a second molded rubber isolator body having a plurality of sockets cooperative with said pins located within said first connector body leading to each of said electrical sleeves and encapsulating at least a portion of said core opposite said second polyurethane body;

b) molding each said first and second polyurethane body around first and second lengths of polyurethane cable sheaths, said wire conductors, and a portion of said pins and said polyurethane core respectively thereby forming a molecular bonded unit;

c) fitting a rubber isolator in place around a portion of said polyurethane core and at least a portion of said conductive pins located opposite said polyurethane body relative to said first connector body; and d) fitting said rubber isolator in place around a portion of said polyurethane core and at least a portion of said conductive sleeves located opposite said polyurethane body relative to said second connector body.

16. The method according to claim 15 further comprising the step of providing a means for adapting a rigid relatable sleeve to each said first and second connector body in a manner whereby said relatable sleeves are threadably coupleable one to the other.

17. The method according to claim 15 further comprising the step of molding said rubber isolator in place around said conductive pins, conductive sleeves, and their respective cores.

18. The method according to claim 15 further comprising the step of providing said first and second electrical cable with said electrical wire conductors having at least one polyurethane insulation sheath and exposing said polyurethane insulation sheath to said polyurethane when molding said polyurethane body.

19. The method according to claim 15 further comprising the step of adapting at least one said connector body to mate with at least one prior art connector.

* * * * *